US005201156A

United States Patent [19]

Newman

[11] Patent Number: 5,201,156

[45] Date of Patent: Apr. 13, 1993

[54] WATER-SHEDDING SPACING MOUNT FOR DECKS AND FENCES

[76] Inventor: William O. Newman, 12458 Fiori La., Sebastopol, Calif. 95472

[21] Appl. No.: 704,278

[22] Filed: May 22, 1991

[51] Int. Cl.[5] ..... E04B 5/14

[52] U.S. Cl. ..... 52/299

[58] Field of Search ..... 446/102, 103, 104, 123; 33/391, 398; 49/171; 70/455; 52/299, 698, 707, 259, 252, 299, 167 R, 745

[56] References Cited

U.S. PATENT DOCUMENTS

| | | | |
|---|---|---|---|
| 1,796,048 | 3/1931 | Robinson | 52/250 |
| 2,525,217 | 10/1950 | Glitsch | 411/169 |
| 3,134,146 | 5/1954 | Geoghegan | 49/171 |
| 3,716,957 | 10/1973 | Bernardi | 52/633 |
| 3,921,356 | 11/1975 | Hughes | 52/299 |
| 4,037,387 | 7/1977 | Molyneux | 52/698 |
| 4,811,542 | 3/1989 | Jewell | 52/741 |
| 4,953,339 | 9/1990 | Jewell | 52/729 |
| 5,005,229 | 4/1991 | Bertoni | 52/707 |

FOREIGN PATENT DOCUMENTS

| | | | |
|---|---|---|---|
| 360314 | 11/1931 | United Kingdom | 446/123 |

*Primary Examiner*—James L. Ridgill, Jr.
*Attorney, Agent, or Firm*—John J. Leavitt

[57] ABSTRACT

A deck and fence mounting block and method of mounting is provided to attach a deck or fence to a building. The deck and fence mounting block comprises a plate-like member with steep top and bottom side edges and an aperture that penetrates the plate along a Y axis along which the length of the plate-like body is measured. The aperture is positioned closer to one end of the plate-like body than to the other so that when the plate is suspened by a bolt assembly or lag bolt extending through the aperture, the plate-like body will hang so that the Y axis is plumb. The deck or fence is thus spaced away from the building so that moisture is quickly deflected from the joint and not allowed to accumulate, the plate-like body being squeezed tightly between the support members to hold them apart.

15 Claims, 1 Drawing Sheet

WATER-SHEDDING SPACING MOUNT FOR DECKS AND FENCES

BACKGROUND OF THE INVENTION

1. Field of the Invention

This invention relates to a deck or fence mounting block or plate-like member or body, and the method of attaching a deck or fence to an adjoining structure.

2. Decription of the Prior Art

One of the problems in attaching a deck or fence to a building or other supporting structure by conventional building methods and standards is that there is a risk that moisture may be trapped and accumulate at the point of attachment and set up a condition that is conducive to the wood rotting at the joint, thus weakening the joint.

Another problem frequently resulting from conventional construction practices is the tendency, mostly inadvertently, to provide "earth-to-wood-contact", thus setting up a condition that is conducive to the attraction of wet-wood termites and the problems attendant thereto.

In the prior art, U.S. Pat. No. 3,716,957 discloses joined metallic H-beam and I-beam structures that support and stiffen each other, utilizing conventional H-beam and I-beam configurations, and embodying a slotted stiffener plate in the union therebetween. This configuration does nothing to deflect or eliminate the accumulation of moisture in the joint between the stiffener plate and the H-beam and I-beam. Additionally, this construction requires a large quantity of mounting bolts, thus increasing the cost of the construction in that it requires skilled employees using expensive equipment to bore the holes and others to place the bolts.

By contrast, the water-shedding spacing mount of the present invention effectively deflects moisture from the joint, and requires only one mounting bolt set through an off-center bolt hole to "capture" the mounting block or plate-like member between two adjacent and joined wood structures.

U.S. Pat. No. 3,921,356 discloses a structure for supporting decks on posts having their lower ends embedded in concrete. The structure, while adapted to support a deck, does not consider the problems inherent to support a wooden deck to an adjoining wooden structure to eliminate the moisture problems inherent in conventional structures at the jointure of a building and a deck or fence. The prior art thus appears to deal with structures which, while giving consideration to the support function, appear to give no consideration to a combined or dual concept of the support function of wooden structures in an environment that requires protection against moisture.

U.S. Pat. No. 4,811,542 discloses a modified metal I beam configuration used to attach and space a deck from a building. This is the only patent found that gives consideration to the problem of retained moisture but, as can be seen from the patent, the structure is totally different and much more complex than the present invention. This prior art structure, when mounted in place, has a horizontal surface that does not deflect moisture from the joint between the building and the deck. Additionally, it requires a large number of bolts and screws to mount. The present invention, by contrast, employing the configuration described hereinafter, efficiently deflects moisture from the joint. Furthermore, it requires only one mounting bolt set through the off-center bolt hole to tie the structure together.

Prior art U.S. Pat. No. 4,811,542 appears to create a space between the deck and building that is much larger than is practical for use in standard building practices. Again, by contrast, the present invention provides a very practical size space to use in accord with standard building practices.

Accordingly, a primary object of the present invention is to provide a deck or fence mounting block or plate for the support of a deck or fence by spaced attachment of a building's internal framing members and the deck or fence in a manner to protect against the accumulation of undesirable moisture in the jointure between the building and the deck or fence.

Another object of the present invention is to provide simpler mounting hardware for the union between a deck and a building which can be more economically used to provide structural strength in an environment and with materials requiring protection against the accumulation of undesirable moisture.

Another object of the present invention is to provide mounting hardware for attaching a deck or fence to the building in a way that doesn't require that the building siding cover the edges of the mounting hardware.

Still another object of the present invention is to provide a deck or fence mounting block or plate that can be set in a bed of exterior caulk at the place where the mounting block meets the siding to prevent against the passage of undesirable moisture.

Yet another object of the present invention is to provide a deck or fence mounting block having steep-angled top and bottom edges that function as flashing to deflect moisture from the joint between the mounting block and the building to thus protect against the accumulation of undesirable moisture.

A still further object of the present invention is to provide a deck or fence mounting block or plate requiring only one bolt for mounting and which hangs plumb during the mounting process.

Another object of the present invention is to provide a method for the assembly of a wooden deck or fence and its attachment to a wooden building or other wooden support structure in a manner to protect against the accumulation of undesirable moisture.

Another object of the present invention is to provide a method of application of a deck or fence mounting block or plate having steep-angled top and bottom edges to function as flashing to deflect moisture from the joint between the mounting block or plate and the building to protect against the accumulation of undesirable moisture in the joint.

The invention possesses other objects and features of advantage, some of which, with the foregoing, will become apparent from the following description and the drawings. It is to be understood however that the invention is not limited to the embodiment illustrated and described, since it may be embodied in various forms within the scope of the appended claims.

SUMMARY OF THE INVENTION

In terms of broad inclusion, the invention forming the subject matter hereof comprises a deck or fence mounting block or plate-like body impervious to moisture and a method of using the mounting block or plate for attaching a deck or fence to a building with an aligned series of spaced metal blocks or plates that are interposed between the deck or fence and the wooden rough framing of the structure to which the deck or fence is attached. Each mounting block spaces the deck or fence from the building and enables the attachment of the deck or fence to the building framing free of the risk of moisture accumulation at the jointure. The deck or fence mounting block or plate may be set in a bed of exterior caulk at the point where the mounting block meets the siding to prevent undesirable moisture accumulation.

Structurally, the deck or fence mounting block includes a thick metal plate, such as aluminum, with steep-angled top and bottom edges forming acute-angled top and bottom apexes. A mounting bolt hole is located off-center in the longitudinal axis of the mounting block, closer to the top apex, so that when the block is supported loosely on a horizontal bolt as shown in FIG. 2 and 3, such as during assembly of the structure, the block or plate hangs plumb with its long dimension vertical because a larger proportion of the mass of the plate, i.e, more than 50% of the mass of the plate, is located below the center of the mounting hole, causing it to hang like a plumb-bob. The steep-angled top edges perform a flashing function, effectively deflecting moisture from the joint between the building and the deck or fence.

A deck or fence may be attached to a building or supporting structure in a manner that moisture cannot accumulate between the deck or fence and the building to which it is attached. The method includes the steps of associating one edge of the deck or fence, such as a ledger board or fence frame upright, in spaced parallelism to the building; running a through-bolt or lag bolt horizontally (as shown in FIG. 2 and 3) through the deck ledger board or fence frame upright, then through the offset aperture in the deck or fence mounting block, then through the building's siding (if any) and into or through the building's internal framing, followed by application and tightening of a nut on the through-bolt to tightly draw the structure together. Caulking the deck or fence mounting block at the place where the flat side of the deck or fence mounting block abuts the building's siding before the deck or fence mounting block is set in place assures the exclusion of moisture between the mounting block and contiguous wood framing members. Conveniently, a ½" or larger through-bolt assembly should be used whenever possible to provide the requisite strength to the joint. Although the novel feature or features believed to be characteristic of the present invention are described in the specification and defined in the claims, the invention and the manner in which it may be carried out may be further understood by reference to the description following and the accompanying drawings.

DESCRIPTION OF THE PREFERRED EMBODIMENT

Figure 1:
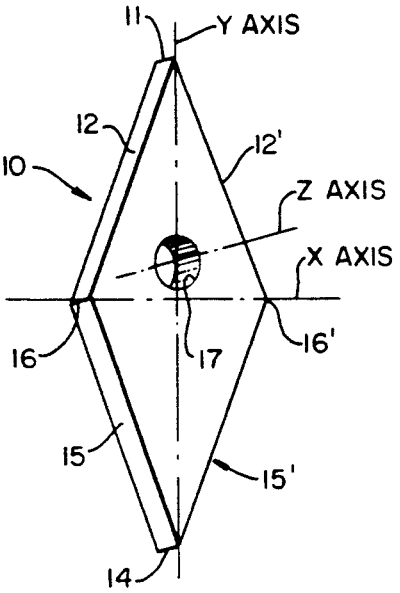
FIG. 1 is a perspective view of the deck or fence mounting block or plate of the present invention, shown apart from other structure.
Figure 2:
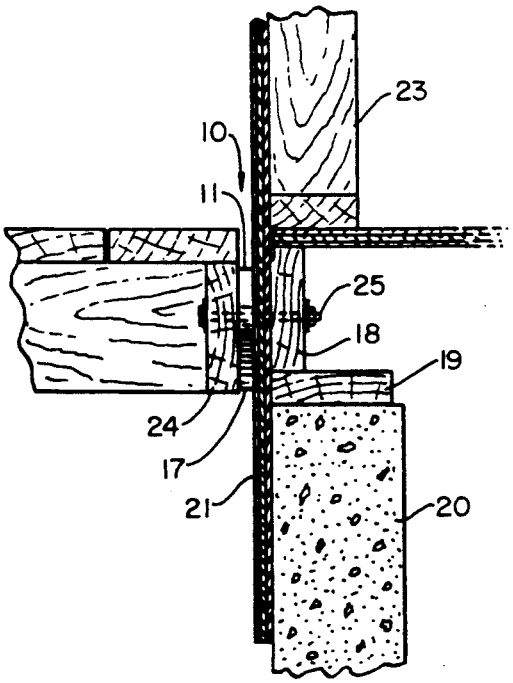
FIG. 2 is a side elevational view of a deck and building, partially in cross-section, showing the deck mounting block or plate of the invention in use in joining a deck to a building. The mounting block or plate is shown in elevation.
Figure 3:
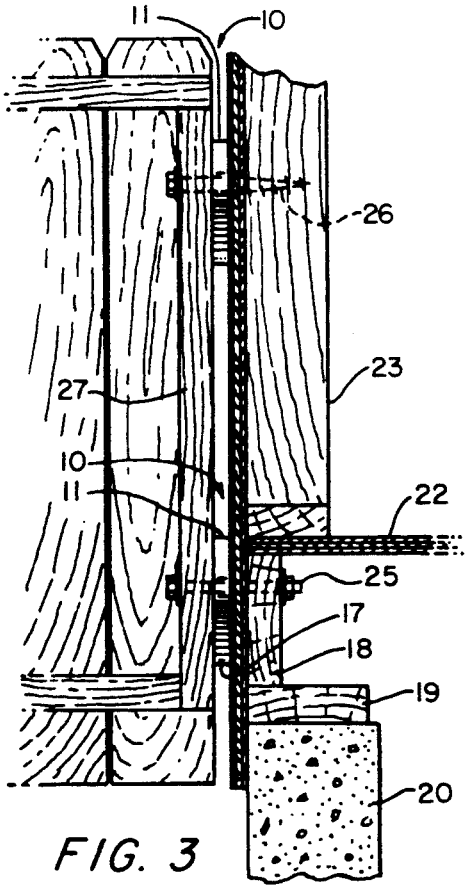
FIG. 3 is a side elevational view of a fence and building, partially in section, showing a pair of the deck or fence mounting blocks or plates of the invention in use in joining a fence to a building. Again, the block or plate is shown in elevation.

In terms of greater detail, the deck or fence mounting block or plate-like body of the present invention, as shown in FIGS. 1 through 3, is designated generally by the numeral 10, and comprises a generally diamond-shaped solid member approximately the form of a parallelopiped, opposite side surfaces of which are parallelograms. The diamond-shaped member is preferably formed by being sawn or sheared from an elongated bar having a generally rectangular cross-section and formed of appropriate material, by cutting or shearing diagonally across the bar at intervals such that the length of the diagonally cut edge equals the length of the intervals at which the bar is cut.

Stated another way, and considering a bar 2.5" wide, choosing an interval along the bar of 2.875" and cutting diagonally across the bar at a 60 degree angle will result in the cut edge of the bar having a length of 2.875". A second cut parallel to the first and made at 60 degrees across the bar at a 2.875" interval from the first cut will result in formation of a diamond-shaped member symmetrical about transverse and longitudinally extending axes, with the member being one-half as wide as it is long.

The configuration of the member thus formed presents top and bottom end edges or apexes 11 and 14, respectively, with upper side edges 12 and 12' diverging from the end edge or apex 11 at 60 degrees between the two side edges, or at 30 degrees between each side edge and a longitudinal axis Y extending between the end edges or apexes 11 and 14 that define the maximum length of the plate-like body. The upper side edges 12 and 12' are intercepted by lower side edges 15 and 15' that diverge at 60 degrees from the end edge or apex 14, thus meeting the side edges 12 and 12' at mid-length of the member 10 to form opposite lateral edges 16 and 16' lying in a horizontal plane coincident with a transversely extending axis X as shown. In position of use, as shown in FIG. 2 and 3, the upper side edges 12 and 12' thus diverge downwardly to a horizontal plane coincident with the X axis, while the lower side edges 15 and 15' diverge upwardly to the horizontal plane, the horizontal plane and the X axis thus extending longitudinally of the spaced supporting members.

It will thus be seen that the total mass of the member is equally divided between the portions of the member above and below the horizontal plane coincident with the transversely extending X axis. That being the case, if the member is supported in the attitude as shown in FIG. 1, at any point along the Y axis above the plane or spaced from the X axis, the member will automatically orient itself so that the Y axis is plumb or nearly so. To enable such support, the member is provided with a bore or aperture 17 having a Z axis perpendicularly intersecting the Y axis and spaced above the intersection of the Y and X axes as shown. I have found a bore having a diameter to rotatably admit passage of a ½" diameter bolt to be quite satisfactory. Obviously, other appropriate diameters of aperture and bolt may be selected depending on the structure to be supported. Additionally, the configuration of the spacer block may be selected so that the axis of the aperture is coincident with the intersection of the X and Y axes and a major portion of the mass of the block lies below the aperture.

In a preferred embodiment of the present invention, when used in joining a deck to a building as illustrated in FIG. 2, a rim joist 18 rests on a mud sill 19, which is in turn supported by the foundation stem wall 20. The siding 21 covers all this structure including the flooring 22 and the wall framing 23. The deck ledger 24 is bolted to the building by a bolt 25 passing through the siding and the rim joist, with the deck and fence mounting block 10 sandwiched in a plumb manner between the deck ledger and the siding with the bolt 25 passing through the bolt hole 17 in the member 10 and through the deck ledger, siding and rim joist. A through-bolt assembly is preferred when possible, especially when the impact of seismic activity is a possible occurence, since it's strength is greater than that of a lag bolt assembly 26 as shown in FIG. 3. In FIG. 2 the deck and fence mounting block member and the siding contact each other with direct surface-to-surface contact. An exterior caulk (not shown) is employed in this joint to further promote the objects of the present invention discussed above, namely, protecting against accumulated moisture and thus preventing wood-rot and discouraging the possibility of termite infestation. The balance of the deck super-structure is intended to be constructed and supported by conventional building materials and methods.

When the present invention is used in joining a fence to a building as shown in FIG. 3, the wall framing 23 rests on the flooring 22, which in turn rests on a rim joist 18 supported on a mud sill 19, itself supported by the foundation stem wall 20, usually formed from concrete. The siding 21 covers all this structure. The fence frame upright 27 is bolted by the bolt 25 to the building through the siding and the rim joist 18, and/or into the wall framing 23, with the deck and fence mounting block 10 of this invention located plumb between the fence frame upright 27 and the siding with the bolts 25 passing through the bolt hole 17. The through-bolt assembly 25 is recommended for use in a preferred embodiment when possible, especially when the impact of seismic activity is a possible occurence since it's strength is greater than that of a lag bolt assembly. As can be seen in FIG. 3, the deck and fence mounting blocks 10, and the siding contact each other with a direct surface-to-surface meeting. An exterior caulk (not shown) is employed in the joints to further promote the objects of the present invention, thus protecting against accumulation of moisture in the joint. The balance of the fence structure is erected by conventional fence building materials and methods.

The deck and fence mounting block 10 hangs plumb while it is being mounted. This is facilitated by the off-center bolt hole 17 as previously explained. After mounting, the deck or fence mounting block 10 is securely held in place by the compression created by bolt assembly 25 or lag screws 26 compressing the deck or fence mounting block 10 between the deck ledger 24 (FIG. 2) or the fence frame upright 27 (FIG. 3) and the siding 21 (FIGS. 2 and 3) depending on whether it is a deck or fence that is being constructed and supported on the associated building.

The acute angles of the edges 12 and 12' act as a flashing, deflecting moisture from the space created by the thickness of the mounting block 10 sandwiched between the siding 21 and the deck ledger 24 or the fence frame upright 27, thus leaving the space free of moisture. The space does not allow any moisture to accumulate.

The use of deck and fence mounting blocks 10 does not complicate the building of a deck or fence. Their surprising simplicity and effectiveness make them easy and attractive to use. No special tools are required, nor is there anything about the configuration of the deck or fence mounting block 10 that would obstruct the use of conventional tools.

The number of deck or fence mounting blocks 10 to be employed in any given situation depends on the strength of the building materials and the size of the deck or fence being constructed or supported. This is easily determined by an experienced builder. The deck or fence mounting block 10 might be made longer, wider or thicker depending on the needs of the situation, for different application requirements. Various situations can also be addressed by one size. A staggered arrangement is one of many possible variations on a standard arrangement.

In a preferred embodiment of the present invention, the deck or fence mounting block or plate 10 is made of at least ½" thick aluminum. The mounting block's composition may be changed to a different metal, or even an appropriate non-metallic material, that performs the same weather resistant and support function. Obviously, the mounting block bolt hole 17 is large enough to accommodate at least a ½" galvanized or zinc coated through-bolt 25 or lag bolt 26.

Figure 4:
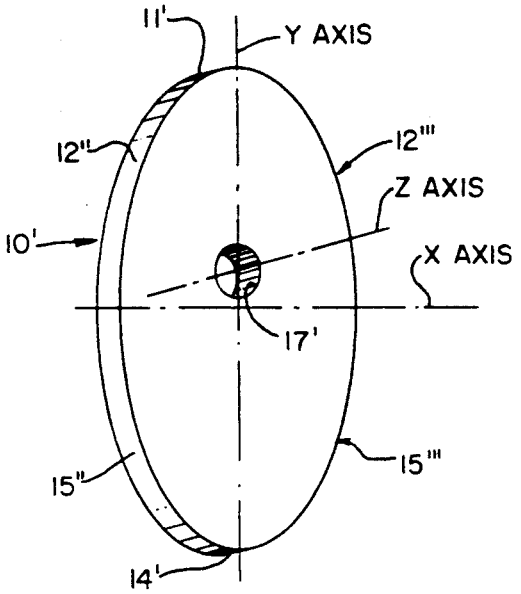
FIG. 4 is a perspective view of a mounting plate of different configuration from that shown in FIG. 1.

Referring to FIG. 4, it will there be seen that the configuration of the peripheral edges of the mounting block have been modified to provide smoothly curved surfaces 12" and 12''' diverging from the apexes 11' and 14', while all other aspects of the mounting block remain the same as that shown in FIG. 1.

Having thus decribed the invention, what is believed to be new and novel and sought to be protected by letters patent of the United States is as follows.

I claim:

1. A plate-like mounting block adapted to form a water or moisture-shedding spacer clamped between two parallel structural members attached to each other by a through-bolt assembly adapted to extend perpendicularly through said parallel structural members and said mounting block, comprising:

a) a plate-like body having a predetermined maximum length measured along a longitudinal Y axis;

b) said plate-like body having a predetermined maximum width measured along a transverse X axis perpendicularly intersecting said Y axis medianly of the long dimension of the plate-like body whereby said plate-like body is symmetrical about said transverse and longitudinally extending axes; and c) an aperture in said plate-like body extending therethrough along a Z axis perpendicularly intersecting said Y axis at a point spaced on one side of said transverse X axis closer to one end of the body than the other whereby a major portion of the mass of said block lies on one side of said aperture, said aperture in said plate-like body accommodating perpendicular passage of said through-body assembly when said mounting block is clamped between said structural members.

2. The mounting block according to claim 1, wherein said plate-like body is formed substantially diamond-shaped with opposed apexes lying in a horizontal plane coincident with said X axis and defining the maximum width of said plate-like body, said opposed apexes spaced longitudinally along said structural members when said mounting block is clamped therebetween.

3. The mounting block according to claim 1, wherein said plate-like body is provided with opposed curvilinear side edges.

4. The mounting block according to claim 3, wherein said opposed curvilinear side edges each constitutes a circular arc the center of which lies on said X axis.

5. The mounting block according to claim 3, wherein each said opposed side edge intersects said Y axis at points equidistant from said X axis.

6. The mounting block according to claim 3, wherein each said opposed side edge is bisected by said X axis.

7. The mounting block according to claim 1, wherein said plate-like body is formed substantially diamond-shaped with opposed apexes coincident with said Y axis and defining opposite ends of plate-like body spaced transverse to said parallel structural members when clamped therebetween.

8. The mounting block according to claim 7, wherein said plate-like body comprises a solid member configured as a parallelopiped having opposite side surfaces constituting spaced and parallel parallelograms and said apexes coincident with said Y axis are diagonally opposed and spaced apart twice the spacing between the apexes coincident with said X axis.

9. The mounting block according to claim 8, wherein said side surfaces and one of said apexes on said Y axis define upper side edges divergent from said one of said apexes and terminating at a plane including said X axis and said apexes coincident therewith.

10. The mounting block according to claim 8, wherein said side surfaces and the other of said apexes on said Y axis define lower side edges divergent from said other of said apexes and terminating at a plane including said X axis and said apexes coincident therewith.

11. The method of orienting a mounting block constituting a spacer between two spaced supporting members, said mounting block constituting a plate-like body having a predetermined length measured along a longitudinal Y axis extending vertically transverse to said spaced supporting members and having an aperture therein symmetrical about a Z axis perpendicular to said Y axis situated closer to one end of the body than the other so that a major portion of the mass of said body lies below said aperture, comprising the steps of inserting said mounting block between said spaced support members, and causing said plate-like body to be suspended between said spaced support members with said Y axis substantially vertically plumb.

12. The method according to claim 11, wherein said plate-like body is suspended between said two spaced support members by a through-bolt assembly inserted through said aperture in said plate-like body and said support members.

13. In combination, a pair of spaced water-absorbent support members having generally parallel mutually-facing surfaces, said support members being adapted to be joined against relative movement in said spaced orientation whereby water falling on said support members may penetrate through the space therebetween, a plate-like mounting block constituting a water or moisture-shedding spacer adapted to be clamped between said mutually-facing surfaces of said spaced support members, said plate-like mounting block being substantially diamond-shaped and longer in a vertical dimension than in a horizontal dimension with opposed upper and lower apexes at opposite ends of the vertical dimension, each apex intercepting the coincident ends of two side edges divergent from the associated apex and intercepting the two side edges divergent from the opposed apex medianly of the vertical dimension of the diamond-shaped mounting block whereby water falling on the upper apex of the mounting block will be directed downwardly through the space between said support members, an aperture in said mounting block closer to the upper apex than to the lower apex so that a major portion of the mass of said mounting block lies below said aperture when said mounting block is disposed between said spaced support members, and means extending horizontally through said spaced support members and through the aperture in said interposed mounting block whereby said mounting block will automatically orient itself with its upper and lower apexes in a vertical orientation with the major portion of the mass of the mounting block below the aperture and the means passing therethrough, said means being manipulable to draw said support members into clamping engagement with said mounting block following said automatic orientation thereof.

14. The combination according to claim 13, wherein said mounting block is impervious to water or moisture, and the width of said mounting block is one-half the length thereof.

15. The combination according to claim 13, wherein said mounting block is formed from an elongated bar having a generally rectangular cross-section by cutting diagonally across the bar at intervals such that the length of the diagonally cut edge signals the length of the intervals at which the bar is cut.

* * * * *